US005360115A

United States Patent [19]

Makino

[11] Patent Number: 5,360,115

[45] Date of Patent: Nov. 1, 1994

[54] SUPPORTING PANEL FOR PACKAGE AND PACKING DEVICE

[75] Inventor: Kuniji Makino, Tokyo, Japan

[73] Assignee: Dainippon Printing Co., Ltd., Tokyo, Japan

[21] Appl. No.: 71,988

[22] Filed: Jun. 7, 1993

[30] Foreign Application Priority Data

Jun. 16, 1992 [JP] Japan ..... 4-180539

[51] Int. Cl.[5] ..... B65D 81/02

[52] U.S. Cl. ..... 206/523; 229/120.34; 229/114; 206/561

[58] Field of Search ..... 229/120.34, 114, 113, 229/104, 171; 206/561, 523

[56] References Cited

U.S. PATENT DOCUMENTS

| | | | |
|---|---|---|---|
| 978,569 | 12/1910 | Elkin | 229/104 X |
| 1,945,878 | 2/1934 | Breton | 229/120.34 |
| 2,587,726 | 3/1952 | Holder et al. | 229/120.34 |
| 3,176,898 | 4/1965 | Seger, Jr. | 229/120.34 |
| 3,749,299 | 7/1973 | Ingle | 229/120.34 |
| 4,553,671 | 11/1985 | Cheesman | 229/114 |
| 4,602,715 | 7/1986 | Sarver | 206/523 |
| 4,640,418 | 2/1987 | Lowry | 206/523 |
| 4,923,065 | 5/1990 | Ridgeway | 206/583 |
| 5,040,678 | 8/1991 | Lenmark, Sr. et al. | 206/523 |

*Primary Examiner*—William I. Price
*Attorney, Agent, or Firm*—Townsend & Banta

[57] ABSTRACT

A supporting panel for package comprises a rectangular base plate. Four inclining plates are formed at sides of the base plate, and provided with erecting plates, respectively. The supporting plates are formed into package members by folding the supporting panels along folds so that the inclining plates are inclined with respect to the base plate and the erecting plates are erected vertically. The packing device is composed of package members formed from the supporting panels which are opposed to each other, and partition plates disposed between the above-mentioned package members, wherein the supporting panels are connected with each other through partition plates. Plural wares can be packed one by one into parts into which a space between the package members are divided.

13 Claims, 5 Drawing Sheets

SUPPORTING PANEL FOR PACKAGE AND PACKING DEVICE

BACKGROUND OF THE INVENTION

1. Field of the Invention

The present invention relates to a supporting panel for package and a packing device which enables fragile wares to be packed safely, and in particular to a supporting panel and a packing device for packing safely fragile wares such as cases for micro-precision products into which photomasks, a color filter, and precision etching products are packed.

2. Description of the Prior Art

Heretofore, as to the above-mentioned supporting panel for package, the applicant disclosed a supporting panel in Utility Model Publication No. 41312 of 1988.

This supporting panel comprises a base plate, four inclining plates connected at four sides of the base plate with the base plate, four erecting plates connected with the inclining plates, respectively and hook-shaped slits which are formed at four corners in the inclining plates.

In fabricating the supporting panels for package into package members, the supporting panels are folded along folds around the hook-shaped slits so that the supporting panels are formed into tray-shaped package members having central portions which are concave.

When using the package members fabricated from the supporting panels for package, upper and lower sides of wares are covered by a pair of the package members.

However, when the above-mentioned supporting panels are formed into tray-shaped package members by using the hook-shaped slits and folding the supporting panels along folds around the hook-shaped slits, a special jig for forming the supporting panel for package into package members is needed, and the supporting panels for package should be formed into a tray-shape by the special jig.

Further, when using the above-mentioned supporting panel for package, it is difficult to safely pack plural wares arranged in parallel.

BRIEF SUMMARY OF INVENTION

It is an object of the present invention to provide a supporting panel for package which can be fabricated into a package member without using adhesive and a special jig, and by folding simply the supporting panels along the folds.

Another object of the present invention is to provide a packing device in which plural wares can be packed together, with the wares being arranged in parallel, and upper and lower sides, right and left sides, and front and rear sides of the wares can be safeguarded.

The first object of the present invention is achieved by a supporting panel for package comprising a rectangular base plate, four inclining plates connected at four sides of the base plate through folds with the base plate, respectively, and four erecting plates connected through folds with the inclining plate, wherein each of the inclining plates has both sides which are formed obliquely so that the inclining plate is made outwardly broader and all or some of erecting plates are provided at one side or both sides thereof with folding and erecting plates through folds.

In the supporting panel for package, the inclining plates have preferably slits into which end portions of the partition plates can be inserted.

The folding and erecting plates are preferably formed at both sides of a pair of opposed inclining panels.

The supporting panel for package according to the present invention which is comprised of a base plate, four inclining plates, and four erecting plates can be easily fabricated into a tray-shaped package member by folding the supporting panel along folds so that the inclining plates are inclined with respect to the base plate, and the erecting plates are erected vertically.

Further the periphery of the package member formed from the supporting panel for package can be strengthened by the insertion of the folding and erecting plates behind adjoining erecting plates.

The second object of the present invention is achieved by a packing device comprising: a pair of supporting panels for package each of which comprises a rectangular base plate, four inclining plates connected at four sides of the base plate through folds with the base plate, respectively, and four erecting plates connected through folds with the inclining plate, respectively, wherein each of the inclining plates has both sides which are formed obliquely so that the inclining plate is made broader outward and has slits into which end portions of the partition plate can be inserted, and all or some of erecting plates are provided at one side or both sides thereof through folds with folding and erecting plates; partition plates end portions of which are inserted into the slits, wherein a pair of package members fabricated by inclining the inclining plate with respect to the base plate, erecting the electing plate vertically, and inserting the folding and erecting plates behind adjoining erecting plates are facing each other through the partition plates, and end portions of the partition plates are inserted into the slits.

In the packing device according to the present invention, a cushion may be provided on the base plate.

Further, in the packing device according to the present invention, the supporting panels for package and the partition plates are preferably made of paper.

The packing device according to the present invention which is comprised of a pair of the supporting panel including a base plate, four inclining plates, and four erecting plates, the supporting panels for package being formed into tray-shaped package member and four erecting plates, and partition plates disposed between a pair of the formed supporting panels into tray-shaped package members, enables upper and lower sides, right and left sides, and front and rear sides of wares to be safeguarded from oscillation and shock from the outside.

Further, in the packing device according to the present invention, since slits are formed in the inclining plates, it is possible to connect the upper supporting plate for package with the lower supporting plate for package as a unit by inserting end portions of the partition plates into the slits of the inclining plates.

Furthermore, plural wares can be packed in the packing device according to the present invention, because a space between the supporting plates are divided into plural parts by the partition plates and wares can be inserted one by one in the respective parts.

DETAILED DESCRIPTION

Figure 1:
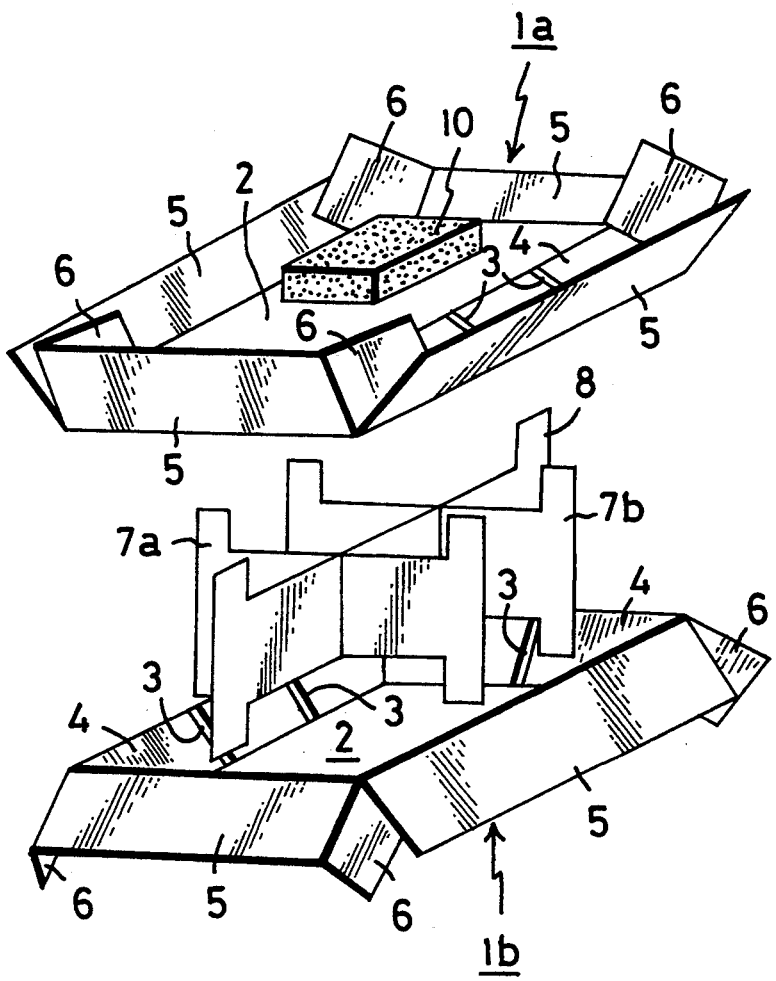
FIG. 1 is an exploded perspective view of a packing device according to the present invention.
Figure 2A:
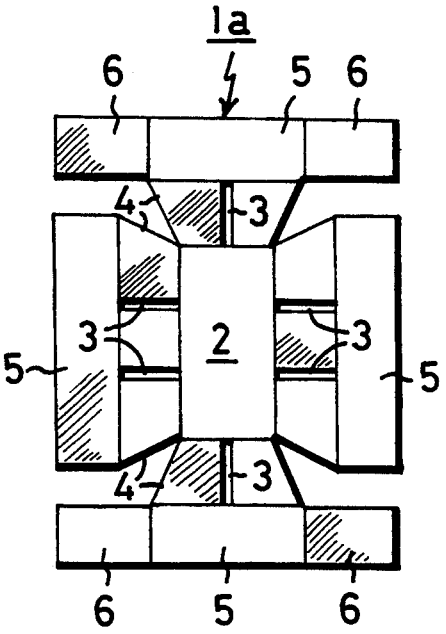
FIG. 2 is a top view of the parts of the packing device which are unfolded.
Figure 2B:
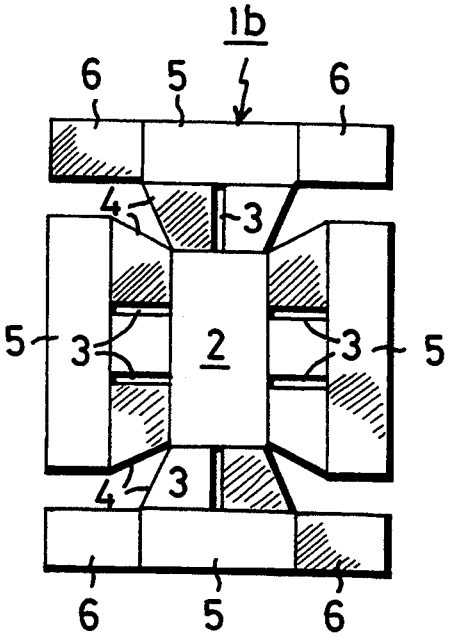
Figure 2C:
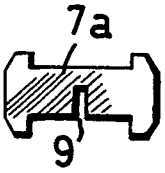
Figure 2D:
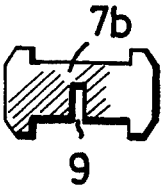
Figure 2E:
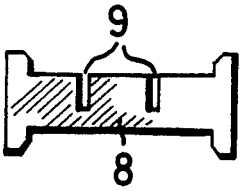

Referring to FIG. 1, supporting panels for package 1*a* and 1*b* according to the present invention comprises a rectangular base plate 2, four inclining plates 4 connected at the four sides of the base plate 2 through folds with the base plate 2, respectively, four erecting plates 5 connected through folds with the inclining plates 4, respectively. Folding and erecting plates 6, or erecting flaps, are connected at both sides of some erecting plates 5.

In the supporting panels for package 1*a* and 1*b*, as shown in FIG. 2, each inclining plate 4 is formed into a figure with four sides, two of which are parallel to each other and the other two of which are formed obliquely with respect to the parallel sides.

Two inclining panels 4 disposed on the right and left of the base plate 2 is formed with two slits 3 at right angles to the right and left sides of the base plate 2, respectively, while the other inclining panels 4 are formed with a slit 3 at right angles to the upper and lower sides of the base plates 2, respectively.

Numerals 7*a*, 7*b* designate small partition plates which have a short horizontal length. End portions thereof are widened as compared with a central portion thereof so that upper and lower edge portions of the end portions project vertically, and the end portion, mainly the upper and lower edge potions thereof can be inserted into the slits 3 formed in the right and left inclining panels 4, respectively. Further, numeral 8 designates a large partition plate which has a long horizontal length. End portions thereof are widened as compared with a central portion thereof so that upper and lower edge portions of the end portions project vertically, and the edge portions, mainly the upper and lower edge portions thereof can be inserted into slits 3 formed in the upper and lower inclining panels 4, respectively. These partition plates 7*a*, 7*b*, and 8 have cuts 9 at the intersectional portions of the partition plates 7*a*, 7*b* and the partition plate 8, respectively so that cuts 9 can be engaged with each other.

Figure 3:
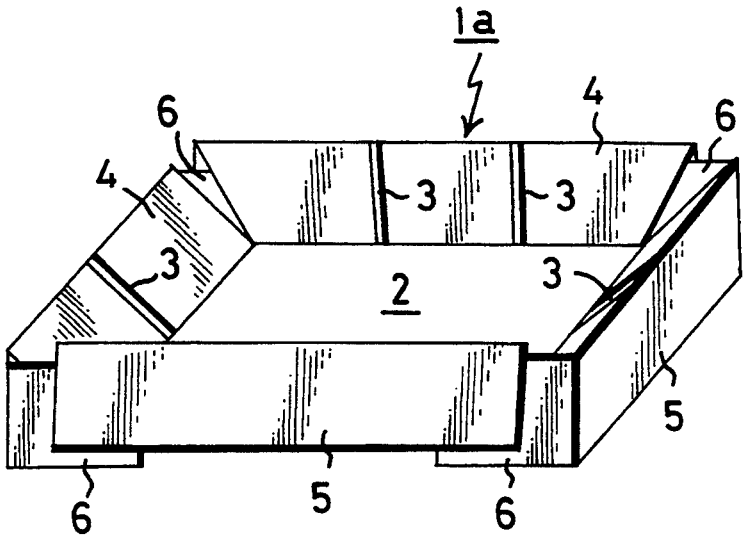
FIG. 3 is a perspective view of a package member which is formed from a supporting panel for package according to the present invention.

When fabricating supporting panels for package 1*a*, 1*b* into package members, as shown in FIG. 3, first, the inclining plates 4 around the base plate 2 are inclined with respect to the base plate 2 so that oblique edges of the adjoining inclining plates 4 are confronted tightly, while the erecting plates 5 are erected vertically. Further, each folding and inclining plate 6 is folded at right angles to the erecting plate 5 and inserted behind the adjoining erecting plate 5 so that the folding and inclining plate 4 can overlap the adjoining erecting plate 5, by which the package member is formed.

Figure 4:
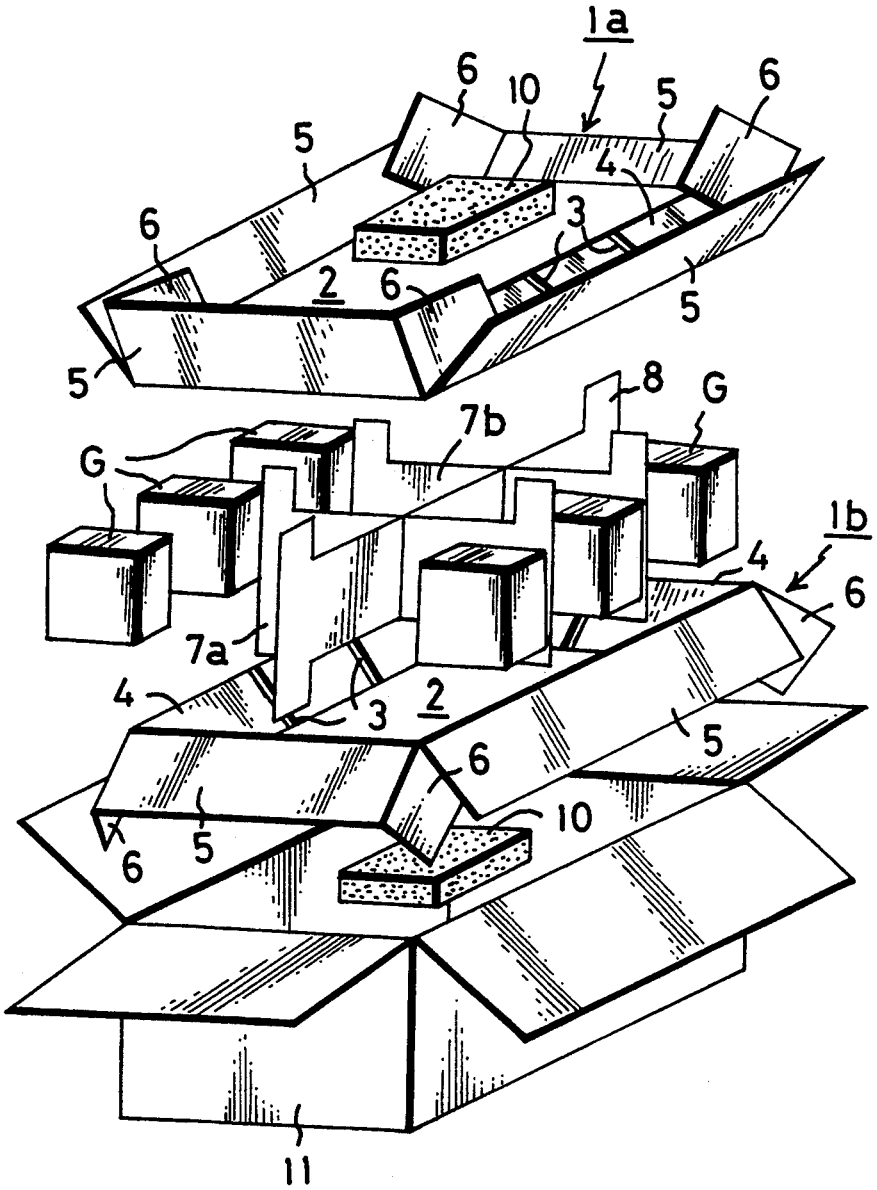
FIG. 4 is a perspective illustration showing a packing step in which wares are packed into a packing device according to the present invention.

Then, when assembling a packing device according to the present invention by using the above-mentioned package members which are formed from the supporting panels for package 1*a*, 1*b*, and small and large partition plates 7*a*, 7*b*, 8, as shown in FIGS. 1 and 4, first, small partition plates 7*a*, 7*b* and large partition plate 8 are joined with each other by engaging the cuts 9.

The small partition plates 7*a*, 7*b* and the large partition plate 8 are then joined with each other and disposed between the package members formed from the supporting panels for package 1*a*, 1*b*. The supporting panels are arranged in such a manner that the inclining plates of both package member are opposed to each other through the small and large partition plates 7*a*, 7*b*, 8. The upper and lower projecting edge portions of the small and large partition plates 7*a*, 7*b*, 8 are inserted into the slits 3 of the supporting panel for package la, lb by which the upper and lower supporting panels for package 1*a*, 1*b* are connected with each other through the small and large partition plates 7*a*, 7*b*, 8 as a unit.

Figure 5:
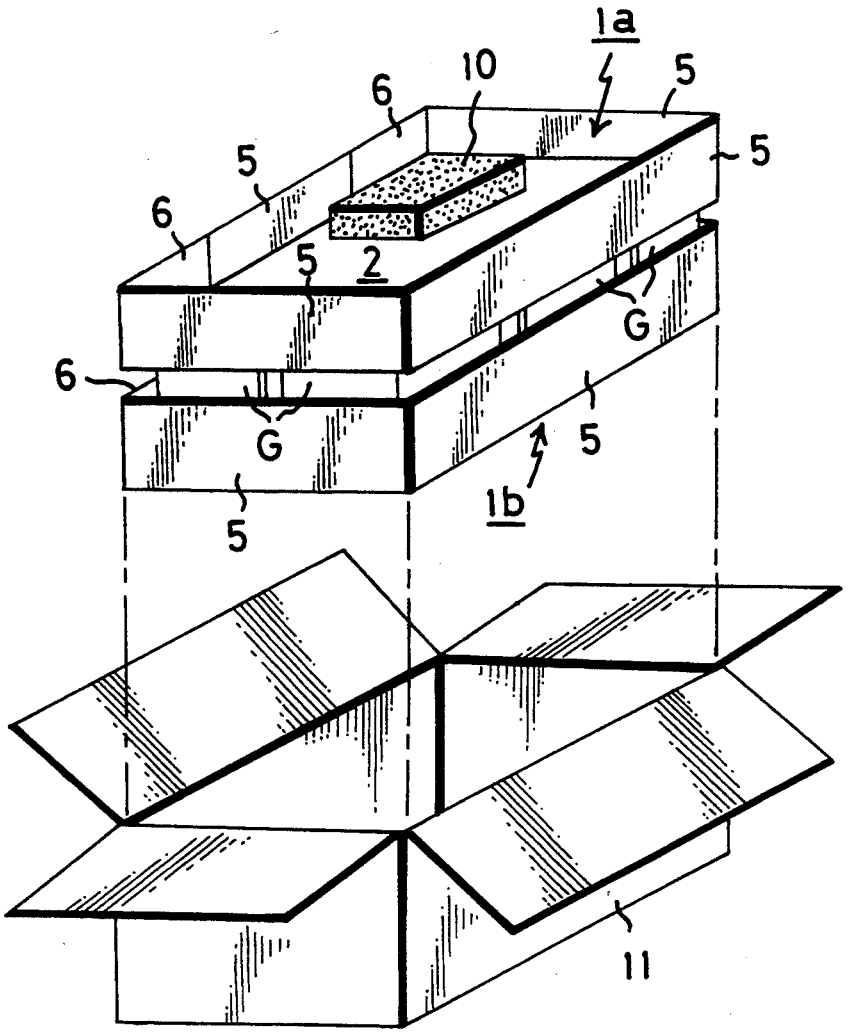
FIG. 5 is a perspective illustration showing a subsequent step following the step shown in FIG. 4 in which the wares are packed into the packing device.

Accordingly, as shown in FIGS. 4 and 5, a plurality of cases G into which wares are packed can be packed one by one into spaces between both supporting panels for package 1*a*, 1*b*. These spaces are formed by the small and large partitions 7*a*, 7*b* so that upper and lower sides, right and left sides, and front and rear sides of cases G into where wares are packed, for example, cases for micro-precision products into which photomasks, a color filter, and precision etching products are packed can be safeguarded, respectively. In case of wares to be packed with fragile products, for example, photomasks, each of which is made of a fragile glass substrate, plural photomasks are packed into a case, and then the case into which photomasks are packed is packed into one of the above-mentioned spaces of the packing device according to the present invention.

In the present invention, cushion boards 10 can be mounted on the back side of the upper and lower supporting plates for package 1*a*, 1*b*. Numeral 11 designates a corrugated cardboard box for packaging the packing devices according to the present invention and wares. Practically, when wares are transported, the packing device according to the present invention into which wares are packed are shielded by such a corrugated cardboard box.

In the above-mentioned embodiment, six cases G can be arranged in six partitions formed by the small partition plates 7*a*, 7*b*, and the large partition plate 8. However, a number of cases G to be packed can be increased or decreased by increasing or decreasing the number of partition plates.

The supporting panel for the package which has the above-mentioned construction and working can easily be fabricated into a tray-shaped package member by folding the inclining plates, the erecting plates, and the folding and erecting plates around the base plate in that order, respectively, without using adhesive or a special device as in the prior art.

Further, since both sides of the inclining plate are formed obliquely, both sides of the adjoining inclining plate can be confronted tightly, and besides the upper openings can be widened.

The packing device according to the present invention which has the above-mentioned construction enables cases into which fragile wares are packed to be packed in parallel.

Furthermore, the respective cases into which wares are packed can be packed independently into the packing device with upper and lower sides, right and left sides, and front and rear sides of the case being safeguarded so that the cases can be shielded from oscillation and shock from the outside.

Further, upper and lower supporting panels for the package are connected through partition plates with each other as a unit, the upper and lower supporting plates being prevented from being disconnected from each other by the oscillation and shock during transportation. Also, the packing device composed of the packing panels and the partition plates is always maintained in a unit for packaging of wares.

Furthermore, since all of the packing device can be made of paper such as paper board, and corrugated board, the packing device can be mass produced at a low price, and is lightweight and destructible by fire after use.

The individual components shown in outline or designated blocks in the Drawings are well known in packing device arts, and their specific construction and operation are not critical to the operation or best mode for carrying out the invention.

While the present invention has been described with respect to what is presently considered to be the preferred embodiment, it is to be understood that the invention is not limited to the disclosed embodiment. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A packing device comprising:

a supporting panel having a rectangular base plate, four inclining plates respectively connected at four sides of the base plate for forming an inner wall supporting packaged things by folding said inclining plates, and four erecting plates respectively connected at an outer edge of each inclining plate for forming an outer wall by folding said erecting plates in the a first direction toward the base plate and folding said inclining plates in a second direction opposite the first direction, a partition made by crossing strips, and said inclining plates having slits in which edge portions of said partition are inserted to be in locking engagement.

2. A packing device according to claim 1, wherein each one of the inclining plates has a trapezoid shape so that an outer edge is wider than an inner edge, and each side edge of said inclining plates meets a side edge of the next inclining plate when folding said inclining plates.

3. A packing device according to claim 1, wherein said erecting plates have erecting flaps folding into a space between said erecting plates and said inclining plates.

4. A packing device according to claim 1, wherein outer edges of said erecting plates are lower than said base plate so as to keep a space below thereof, and a cushion is disposed in said space to fill a gap between outer edges of said erecting plate and base plate.

5. A packing device according to claim 1, wherein said base, said inclining plates and said erecting plates are made of paper.

6. A packing device comprising:

a pair of supporting panels for package, each supporting panel having a rectangular base plate, four inclining plates respectively connected at four sides of the base plate for forming an inner wall and four erecting plates respectively connected at an outer edge of said inclining plates for forming an outer wall, said inner wall supporting package things formed by folding said inclining plates in a first direction toward the base plate, said outer wall formed by folding said erecting plates in a second direction opposite the first direction, and a partition for supporting packaged things;

said pair of supporting panels being respectively disposed on and under said partition for clamping said partition with said base plates and inclining plates of said pair of supporting panels.

7. A packing device according to claim 6, wherein said inclining plates have slits in which edge portions of said partition are inserted to be in locking engagement with said inclining plates.

8. A packing device according to claim 6, wherein said partition is formed of two or more strips in locking engagement and approximately at right angles to one another.

9. A packing device according to claim 6, wherein each one of the inclining plates has a trapezoid shape in which an outer edge is wider than an inner edge, and each side edge of said inclining plates meets a side edge of an adjacent inclining plate when said inclining plates are folded.

10. A packing device according to claim 6, wherein said erecting plates have erecting flaps folding into a space between said erecting plates and said inclining plates.

11. A packing device according to claim 6, wherein outer edges of folded erecting plates are higher than said base plate, and a cushion is disposed on said base plate for filling a gap between the height of said outer edges of said erecting plates and base plate.

12. A packing device according to claim 6, wherein said base plate, said inclining plates, said erecting plates and said partition are made of paper.

13. A packing device according to claim 6, further comprising a box into which said pair of supporting panels and partition are disposed.

* * * * *